US010800622B2

(12) United States Patent
Rietbergen et al.

(10) Patent No.: US 10,800,622 B2
(45) Date of Patent: Oct. 13, 2020

(54) SHEET CONVEYING SYSTEM

(71) Applicant: Océ Holding B.V., Venlo (NL)

(72) Inventors: Mark Rietbergen, Venlo (NL); Pascal Driessen, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/273,880

(22) Filed: Feb. 12, 2019

(65) Prior Publication Data

US 2019/0256310 A1 Aug. 22, 2019

(30) Foreign Application Priority Data

Feb. 20, 2018 (EP) ..... 18157519

(51) Int. Cl.
*B65H 5/22* (2006.01)
*B65H 5/02* (2006.01)
*B65H 29/24* (2006.01)

(52) U.S. Cl.
CPC ..... *B65H 5/224* (2013.01); *B65H 5/021* (2013.01); *B65H 29/242* (2013.01); *B65H 2301/44735* (2013.01); *B65H 2406/321* (2013.01); *B65H 2406/3223* (2013.01); *B65H 2406/3622* (2013.01)

(58) Field of Classification Search
CPC ..... B65H 5/224; B65H 29/242; B65H 5/021; B65H 2404/283; B65H 2406/3124; B65H 2406/322; B65H 2406/3221; B65H 2406/321; B65H 2406/3223; B65H 2406/36; B65H 2406/3632; B65H 2406/3622
See application file for complete search history.

(56) References Cited

U.S. PATENT DOCUMENTS 6,382,850 B1 * 5/2002 Freund ..... B41J 3/60 347/102
2019/0291985 A1 * 9/2019 Serra Obiols ..... B65H 3/34

FOREIGN PATENT DOCUMENTS

EP 0 453 790 A1 10/1991
EP 1 063 096 A2 12/2000
WO WO 2017/198885 A1 11/2017

OTHER PUBLICATIONS

Search Report issued in European Patent Application No. 18157519.2, dated Aug. 27, 2018.

* cited by examiner

*Primary Examiner* — David H Bollinger
(74) *Attorney, Agent, or Firm* — Birch, Stewart, Kolasch & Birch, LLP

(57) ABSTRACT

A sheet conveying system comprising a first conveyor and a second conveyor arranged downstream of the first conveyor in a transport direction for taking-over a sheet from the first conveyor, the first conveyor having a belt that is driven to move over a stationary attraction mechanism, the attraction mechanism being arranged to exert, onto a sheet conveyed on the first conveyor, an attraction force that is proportional to an area of coverage of the sheet on the attraction mechanism, characterized in that the attraction mechanism is arranged to attract the sheet with a larger force per area in a downstream zone of the first conveyor than in an upstream zone thereof.

14 Claims, 1 Drawing Sheet

SHEET CONVEYING SYSTEM

Figure 1:
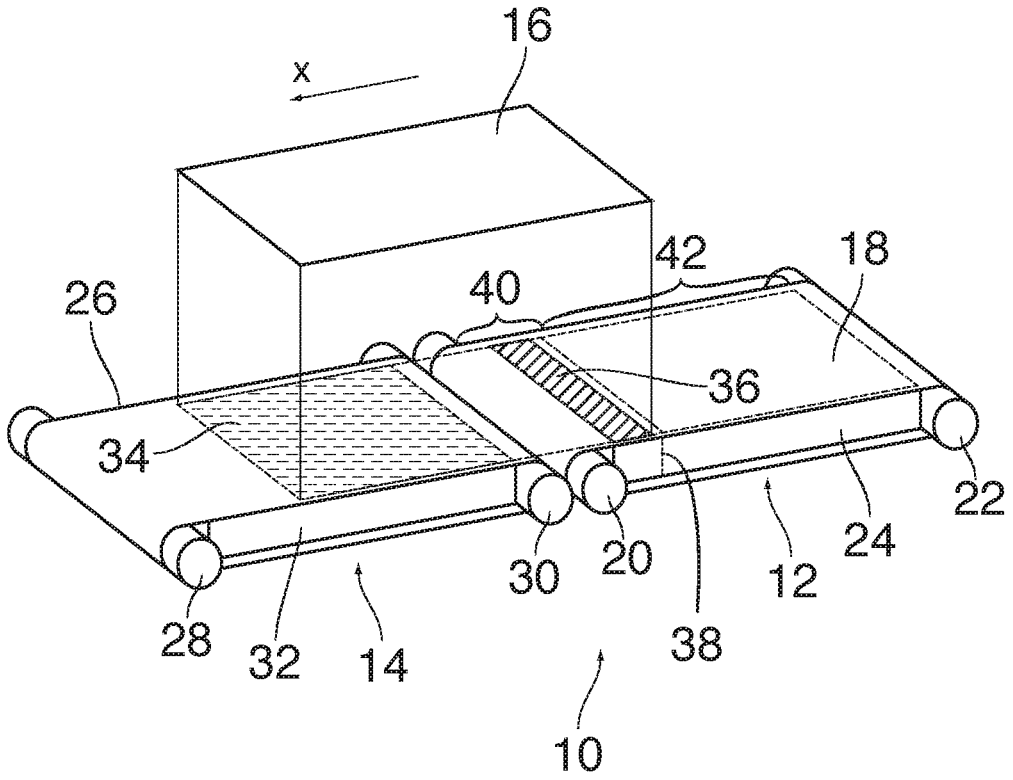

The invention relates to a sheet conveying system comprising a first conveyor and a second conveyor arranged downstream of the first conveyor in a transport direction for taking-over a sheet from the first conveyor, the first conveyor having a belt that is driven to move over a stationary attraction mechanism, the attraction mechanism being arranged to exert, onto a sheet conveyed on the first conveyor, an attraction force that is proportional to an area of coverage of the sheet on the attraction mechanism.

More particularly, the invention relates to a sheet conveying system in a printer. Then, the first conveyer may serve to move the sheet past a print station where an image is formed on the surface of the sheet, and the second conveyor may be used to move the sheet through a post-processing stage such as a fuse station or curing station.

The print process performed in a print station is an example of a process the quality of which depends critically upon the uniformity of the speed with which the sheet is conveyed by the first conveyor. If the first and second conveyors are driven independently of one another, it is difficult to synchronize the conveying speeds of the two conveyors with high precision, and a situation may occur where the second conveyor tends to move the sheet with a slightly higher speed than the first conveyor. Then, as the sheet is passed on from the first conveyor to the second conveyor, the area of coverage of the sheet on the attraction mechanism that attracts the sheet to the first conveyor is gradually reduced to zero, so that the first conveyor increasingly loses grip of the sheet, until a point is reached where the force exerted by the second conveyor becomes dominant and the trailing part of the sheet is drawn-off from the first conveyor at an elevated speed. If, at that instant, the print process is not yet completed, the print quality will be compromised.

One way to avoid this effect is to make the belt of the first conveyor so long that the print process can be completed before a substantial part of the sheet has entered the action zone of the second conveyor. However, this means that the overall length of the sheet conveying system in the transport direction increases substantially with increasing length of the sheets to be processed.

It is an object of the invention to provide a sheet conveying system which can assure a high process quality and nevertheless has reduced dimensions in comparison to the maximum length of the sheets to be processed.

In order to achieve this object, the sheet conveying system according to the invention is characterized in that the attraction mechanism is arranged to attract the sheet with a larger force per area in a downstream zone of the first conveyor than in an upstream zone thereof.

In this system, when the sheet is about to leave the first conveyor, the trailing part of the sheet will still cover the downstream zone of the first conveyor where the attraction force is high, so that the first conveyor continues to have a strong grip on the sheet. This shifts the point at which the drive force exerted by the second conveyor becomes dominant in downstream direction of the conveying system, and, as a consequence, a larger fraction of the length of the belt of the first conveyor can be utilized for processing the sheet under a condition in which the speed of the sheet remains constant.

More specific optional features of the invention are indicated in the dependent claims.

The belt of the first conveyer may be perforated, and the attraction mechanism may be formed by a suction box disposed underneath the belt for drawing-in air through the perforations of the belt, thereby to attract the sheet to the belt.

In general, the gravitational force that urges the sheet against the surface of the belt due to its own weight can also be considered as a kind of attraction mechanism. If the gravitational force is sufficient for reliably holding the sheet on the belt, the suction box which is arranged to attract the sheet with a higher force may be confined to the downstream zone of the first conveyor.

In another embodiment, the suction box may be segmented into at least an upstream zone and a downstream zone, and the downstream zone may be operated with a lower absolute pressure so as to attract the sheet with higher force.

Optionally, the second conveyor may also comprise the perforated belt and a suction box.

In order to prevent the sheet, e.g. a sheet of paper, for forming a blouse at the transition between the first and the second conveyors, it may be convenient to purposely control the second conveyor so as to drive the sheet with a slightly higher speed than the first conveyor. Due to the increased attraction force of the attraction mechanism, the speed of the sheet will still be controlled by the first conveyor while the second conveyor will slightly slip relative to the sheet, thereby putting the sheet under slight tension without changing the speed of the sheet.

In order to reduce the friction with which the belt of the first conveyor slides over the downstream part of the attraction mechanism, it may be convenient to equip the top surface of the attraction mechanism in the downstream zone with an array of rollers or with an anti-friction coating.

Conversely, an anti-friction coating on the top surface of the belt of the second conveyor may reduce the drive force that the second conveyor exerts upon the sheet, so that the instant at which the second conveyor becomes dominant is delayed even further.

If the second conveyor tends to drag the sheet off the belt of the first conveyor, the friction between the sheet and the belt of the first conveyor may tend to accelerate the first conveyor. This effect can be avoided by feedback-controlling the speed of the first conveyor.

The second conveyor may in general have a belt that is driven to move over a second attraction mechanism, the second attraction mechanism being arranged to exert, onto a sheet conveyed on the second conveyor, an attraction force that is proportional to an area of coverage of the sheet on the second attraction mechanism.

The attraction mechanism of the first conveyor may in that case be arranged to attract a sheet with a larger force per area in a downstream zone of the first conveyor than that the second attraction mechanism is arranged to attract a sheet with, to prevent a force exerted onto a sheet by the second conveyor from too early becoming dominant over a force exerted onto a sheet by the first conveyor during transfer of a sheet from the first conveyor to the second conveyor.

Figure 2:
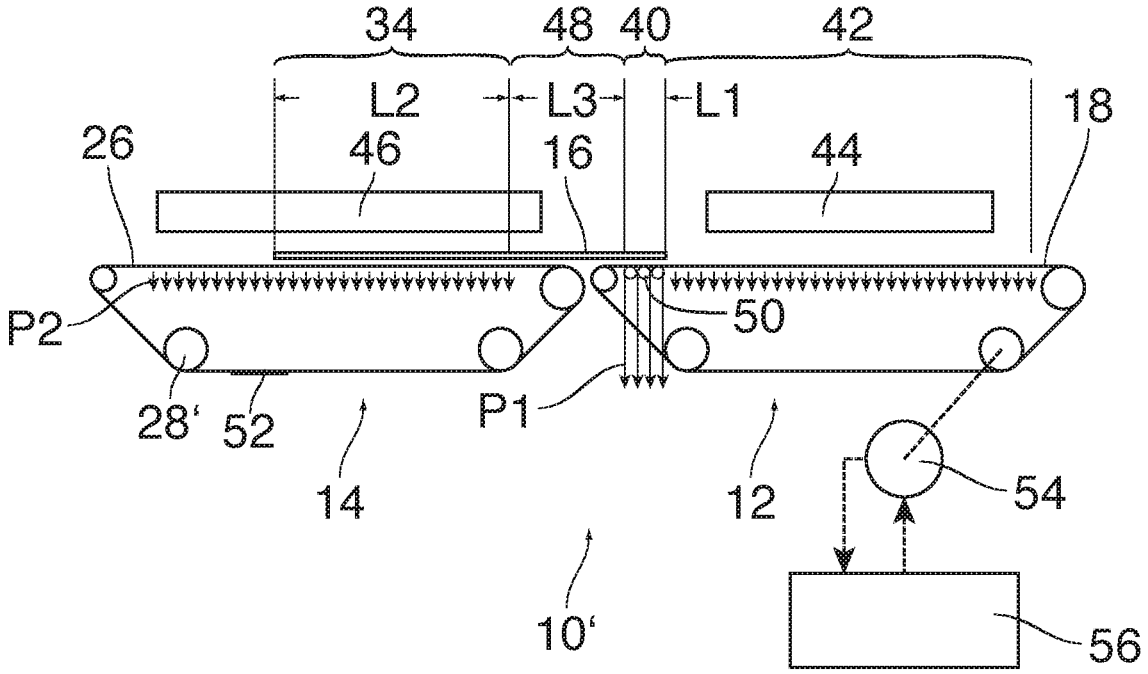

An embodiment example will now be described in conjunction with the drawings, wherein:

FIG. 1 is a schematic perspective view of a sheet conveying system according to the invention; and FIG. 2 is a schematic side view of a printing system comprising a sheet conveying system according to the invention.

As is shown in FIG. 1, a sheet conveying system 10 comprises a first conveyor 12 and a second conveyor 14. The second conveyor 14 is arranged downstream of the first conveyor 12 in a transport direction x for taking-over a sheet 16 from the first conveyor 12. In the drawing, the sheet 16 has been shown in an exploded view, "hovering" at a distance above the surfaces of the conveyors 12, 14.

The first conveyor 12 has a perforated endless belt 18 (the perforations are not shown in the drawing) trained around two rollers 20, 22 at least one of which is driven for rotation, so that a top run of the belt 18 moves in the transport direction x. An attraction mechanism 24 is disposed in a space between two rollers 20, 22 and the top and bottom runs of the belt 18. In this example, the attraction mechanism 24 is constituted by a suction box in which a suction pressure (sub-atmospheric pressure) is maintained and which has openings in the top surface facing the top run of the belt 18, so that ambient air is drawn-in through the perforations of the belt 18 and the openings of the suction box. As a consequence, the sheet 16, as long as it rests on the first conveyor 12, will be attracted to the belt 18 by a suction force that is proportional to the area of coverage of the sheet 16 on the suction box and to the suction pressure in the suction box.

In other embodiments, the attraction mechanism 24 might use electrostatic or magnetic forces for attracting the sheet 16 to the belt 18.

In the example shown, the second conveyor 14 also comprises an endless perforated belt 26 trained around two rollers 28, 30 one of which is driven for a rotation. The space between the rollers 28, 30 and the top and bottom runs of the belt 26 accommodates another suction box 32 attracting the sheet 16 with an attraction force that is proportional to the suction pressure in the box 32 and the area of coverage of the sheet 16 with the suction box 32.

In the condition shown in FIG. 1, a leading part of the sheet 16 has already reached the second conveyor 14 and forms an area of coverage 34 (indicated by light hatching) with the suction box 32. A trailing part of the sheet 16 is still in the area of the first conveyor 12 and forms an area of coverage 36 (indicated by dark hatching) with the suction box constituting the attraction mechanism 24.

The first conveyor 12 exerts onto on the trailing part of the sheet 16 a holding force F1 that resists a relative movement of the sheet 16 and the belt 18, in particular in the transport direction x. This holding force is given by:

$$F1=P1*A1*\mu 1$$

wherein P1 is the suction pressure in the part of the attraction mechanism 24 underneath the trailing part of the sheet, A1 is the area content of the area of coverage 36, and μ1 is the coefficient of friction between the sheet 16 and the top surface of the belt 18. It will be observed that the attraction force exerted by the attraction mechanism 24 is given by P1*A1.

Similarly, the second conveyor 14 exerts a holding force T2 x onto the leading part of the sheet 16, and this holding force is given by:

$$F2=P2*A2*\mu 2$$

wherein P2 is the suction pressure in the suction box 32, A2 is the area content of the area of coverage 34, and μ2 is the coefficient of friction between the sheet 16 and the top surface of the belt 26.

It shall now be assumed that the speed of the belt 26 in the transport direction x is slightly larger than the speed of the belt 18. Then, the holding force F2 of the second conveyor 14 will tend to hold the sheet 16 stationary relative to the belt 26, i.e. it will tend to move the sheet in positive x-direction with the higher of the two conveyor speeds. The holding force F1 of the first conveyor 12 will tend to hold the sheet stationary relative to the belt 18 and will tend to hold back the sheet so that it moves only with the smaller speed of the first conveyor. As long as a major part of the sheet 16 is still on the first conveyor 12, the holding force F1 will dominate, and the belt 26 of the second conveyor 14 will slip relative to the sheet. However, as the sheet is conveyed further in positive x-direction, the area of coverage 36 shrinks and the area of coverage 34 increases, so that, at some point, the balance will tip and the holding force F2 will dominate the holding force F1. At that point, the sheet will be accelerated in positive x-direction, which may be detrimental to a process applied to the trailing part of the sheet 16 that is still on the first conveyor 12.

In order to delay this tipping point as far as possible, the attraction mechanism 24 has a partition 38 which divides the suction box into two compartments and divides the first conveyor 12 into a downstream zone 40 and an upstream zone 42. The partition 38 permits to maintain different suction pressures in the parts of the suction box constituting the attraction mechanism 24. The suction pressure in the upstream zone 42 is adjusted such that the sheet 16 is reliably fixed on the belt 18 in its entire area, but with a minimum of power consumption. The suction pressure in the suction box 32 of the second conveyor 14 may be controlled to be equal to the suction pressure in the upstream zone 42 of the first conveyor. However, an increased suction pressure is maintained in the part of the attraction mechanism 24 that extends over the downstream zone 40, so that, here, the sheet 16 is attracted with a higher force, leading to a higher holding force F1 that is exerted by the first conveyor 12 when the trailing edge of the sheet 16 has passed the partition 38. On the other hand, since the increased suction pressure P1 is generated only in a relatively small area, the increase in power consumption is only moderate.

The ratio F1/F2 between the holding forces F1 and F2 is given by the ratio P1/P2 between the suction pressure P1 in the downstream zone 40 and the suction pressure P2 in the suction box 32. Thus, by increasing the suction pressure P1, the position of the trailing edge of the sheet 16 at which the balance between the forces F1 and F2 tips in favor of F2 can be shifted in positive x-direction.

FIG. 2 shows a more detailed and more realistic view of a sheet conveying mechanism 10' wherein each of the belts 18 and 26 has been trained around a guide assembly with four rollers 28'. The suction pressures and created by the attraction mechanism 24 and the suction box 32 have been symbolized by arrows, the longer arrows in the downstream zone 40 of the first conveyor indicating that the suction pressure P1 in this zone is larger than the suction pressure P2 in the upstream zone 42 and in the second conveyor 14.

In the example shown in FIG. 2, the sheet conveying mechanism 10' serves for conveying the sheet 16 through a printing system having a printing stage 44, e.g. an ink jet print head assembly, disposed above the first conveyor 12, and a curing stage 46 disposed above the second conveyor 14.

The downstream zone 40 has a length L1 in the transport direction x. Preferably, the length L1 is smaller than 25% of the total length of the first conveyor (12).

If the total length of the sheet 16 in that direction is given by L, then the area of coverage 34 between the downstream part of the sheet 16 and the suction box 32 has a length L2=L−L1−L3, wherein L3 is the length of a gap between the downstream end of the attraction mechanism 24 and the upstream end of the suction box 32.

In order to assure that the sheet 16 moves reliably with the speed of the belt 18 at least until the trailing edge of the sheet reaches the downstream zone 40, the ratio P1/P2 should fulfill the following condition:

$$P1/P2 \geq \mu 2 * A2/\mu 1 * A1 = \mu 2 * L2/\mu 1 * L1.$$

In a practical embodiment, the total length L of the sheet may be 66 cm, L1 may be 5 cm and L3 may be 11 cm, resulting in L2=50 cm. Then, the above condition would be fulfilled for example if $$P1/P2 \geq 10.$$

Since a high value of P1 leads to increased friction between the top surface of the attraction mechanism 24 and the bottom (internal) side of the belt 18, the first conveyor 12 shown in FIG. 2 is equipped with small rollers 50 which support the belt 18 in the downstream zone 40. As an alternative, the attraction mechanism could be provided with an anti-friction coating at least in the downstream zone 40.

Further, in order to reduce the friction coefficient μ2, the belt 26 may be equipped with an anti-friction coating 52 a small portion of which has been shown in FIG. 2. For example, the anti-friction coating 52 may be formed of tetrafluoroethylene.

As is further shown in FIG. 2, the belt 18 is driven by a motor 54 that is feedback-controlled by a controller 56, so as to keep the speed of the belt 18 constant with high accuracy, regardless of any possible forces that may be exerted by the drive system of the second conveyor 14 via the sheet 16.

In case the attraction mechanism 24 of the first conveyor 12 is arranged to attract a sheet 16 in the downstream zone 40 with a force per area larger than a force per area that the attraction mechanism 32 of the second conveyor 14 is arranged to attract a sheet 16 with, a force exerted onto a sheet 16 by the second conveyor 14 is prevented from too early becoming dominant over a force exerted onto a sheet 16 by the first conveyor 12 during transfer of a sheet 16 from the first conveyor 12 to the second conveyor 14.

In principle, the latter feature is also applicable without the attraction mechanism 24 of the first conveyor 12 being arranged to attract a sheet 16 with a larger force per area in a downstream zone 40 of the first conveyor 12 than in an upstream zone 42 of the first conveyor 12. As long as the attraction mechanism 24 of the first conveyor 12 is arranged to attract a sheet 16 in any area with a force per area larger than a force per area that the attraction mechanism 32 of the second conveyor 14 is arranged to attract a sheet 16 with, the advantage is obtained of a force exerted onto a sheet 16 by the second conveyor 14 being prevented from too early becoming dominant over a force exerted onto a sheet 16 by the first conveyor 12 during transfer of a sheet 16 from the first conveyor 12 to the second conveyor 14.

The invention claimed is:

1. A sheet conveying system comprising a first conveyor and a second conveyor arranged downstream of the first conveyor in a transport direction for taking-over a sheet from the first conveyor, the first conveyor having a belt that is driven to move over a stationary attraction mechanism, the attraction mechanism being arranged to exert, onto a sheet conveyed on the first conveyor, an attraction force that is proportional to an area of coverage of the sheet on the attraction mechanism, characterized in that the attraction mechanism is arranged to attract the sheet with a larger force per area in a downstream zone of the first conveyor when the sheet is in the downstream zone than in an upstream zone of the first conveyor when the sheet is in the upstream zone.

2. The sheet conveying system according to claim 1, wherein the attraction mechanism comprises a suction box having a partition that divides the suction box into two compartments in which different suction pressures can be maintained, the partition defining a border between the downstream zone and the upstream zone of the first conveyor.

3. The sheet conveying system according to claim 1, wherein a length of the downstream zone in the transport direction is smaller than 25% of a total length of the first conveyor.

4. The sheet conveying system according to claim 1, wherein the second conveyor comprises an endless belt and a suction box for attracting the sheet against the belt of the second conveyor.

5. The sheet conveying system according to claim 4, wherein the belt of the second conveyor has an anti-friction coating on a surface which supports the sheet.

6. The sheet conveying system according to claim 1, wherein the attraction mechanism has an anti-friction coating or rollers supporting a portion of the belt in the downstream zone on the attraction mechanism.

7. The sheet conveying system according to claim 1, wherein the first conveyor is driven by a motor that is controlled by a controller so as to keep the conveying speed constant.

8. The sheet conveying system according to claim 1, wherein the second conveyor has a belt that is driven to move over a second attraction mechanism, the second attraction mechanism being arranged to exert, onto a sheet conveyed on the second conveyor, an attraction force that is proportional to an area of coverage of the sheet on the second attraction mechanism.

9. The sheet conveying system according to claim 8, wherein the second belt is perforated.

10. The sheet conveying system according to claim 8, wherein the second attraction mechanism comprises a suction box.

11. A printer comprising the sheet conveying system according to claim 1, wherein the first conveyor serves to move a sheet past a print station where an image is formed on a surface of the sheet.

12. The printer according to claim 11, wherein the second conveyor is used to move a sheet past a post-processing station.

13. The printer according to claim 12, wherein the post-processing station is a fuse station or curing station.

14. A sheet conveying system comprising a first conveyor and a second conveyor arranged downstream of the first conveyor in a transport direction for taking-over a sheet from the first conveyor, the first conveyor having a belt that is driven to move over a stationary attraction mechanism, the attraction mechanism being arranged to exert, onto a sheet conveyed on the first conveyor, an attraction force that is proportional to an area of coverage of the sheet on the attraction mechanism, characterized in that the attraction mechanism is arranged to attract the sheet with a larger force per area in a downstream zone of the first conveyor than in an upstream zone thereof, wherein the second conveyor has a belt that is driven to move over a second attraction mechanism, the second attraction mechanism being arranged to exert, onto a sheet conveyed on the second conveyor, an attraction force that is proportional to an area of coverage of the sheet on the second attraction mechanism, and wherein the attraction mechanism of the first conveyor is arranged to attract a sheet with a larger force per area in a downstream zone of the first conveyor than that the second attraction mechanism is arranged to attract a sheet with.

* * * * *